United States Patent [19]

Goloff

[11] 4,008,016

[45] Feb. 15, 1977

[54] OIL COOLED SEAL FOR ROTARY ENGINE

[75] Inventor: Alexander Goloff, East Peoria, Ill.

[73] Assignee: Caterpillar Tractor Co., Peoria, Ill.

[22] Filed: June 2, 1975

[21] Appl. No.: 583,238

[52] U.S. Cl. ..... 418/92; 418/124; 277/15; 277/72 R; 277/75

[51] Int. Cl.[2] ..... F01C 21/06; F16J 15/16

[58] Field of Search ..... 418/92, 113, 122, 123, 418/124, 91, 119, 120, 121, 125, 140, 142; 277/15, 70, 72, 75, 79

[56] References Cited

UNITED STATES PATENTS

| | | | |
|---|---|---|---|
| 1,873,267 | 8/1932 | Bigelow et al | 277/72 X |
| 2,554,234 | 5/1951 | Baudry et al | 277/15 |
| 3,206,108 | 9/1965 | Abermeth | 418/91 X |
| 3,261,334 | 7/1966 | Paschke | 418/91 X |
| 3,296,943 | 1/1967 | Rosman | 277/15 |
| 3,366,317 | 1/1968 | Keylwert | 418/91 X |
| 3,716,312 | 2/1973 | Panhard | 418/94 |
| 3,799,709 | 3/1974 | Reitz et al. | 418/91 |

FOREIGN PATENTS OR APPLICATIONS

| | | | |
|---|---|---|---|
| 1,401,401 | 10/1968 | Germany | 418/92 |
| 911,997 | 12/1962 | United Kingdom | 277/72 |

*Primary Examiner*—Carlton R. Croyle
*Assistant Examiner*—Leonard Smith
*Attorney, Agent, or Firm*—Wegner, Stellman, McCord, Wiles & Wood

[57] ABSTRACT

An improved apex seal for a rotary engine of the type having a housing with an interior wall and a rotor having plural apices within the housing. A plurality of apex seals are provided, one at each of the apices on the rotor, for establishing a seal between the rotor and the interior wall of the housing. Each of the seals is thin walled and hollow and further includes a fluid inlet and a fluid outlet. Conduits are provided in the rotor for directing a coolant through each of the seals via the inlets and the outlets so as to control seal temperature and thereby minimize seal wear.

2 Claims, 3 Drawing Figures

OIL COOLED SEAL FOR ROTARY ENGINE

BACKGROUND OF THE INVENTION

This invention relates to rotary engines and, more specifically, to improved apex seals for rotary engines. Prior art of possible relevance includes U.S. Pat. No. 3,716,312 to Panhard.

While the basic operating and construction principles of rotary engines, such as the so-called "Wankel" engine, have been known for many years, rotary engines have yet to be commercialized to any appreciable extent. A principal difficulty and obstacle to such commercialization is a lack of reliability, most notably in the seals employed for sealing the rotor against the housing. Consequently, there is a real need for new and improved seals for rotary engines, such as a new and improved apex seal.

SUMMARY OF THE INVENTION

It is the principal object of the invention to provide a new and improved apex seal for a rotary engine. More specifically, it is an object of the invention to provide a new and improved rotary engine embodying such a seal.

An exemplary embodiment of the invention achieves the foregoing objects in a rotary engine including a housing having an interior wall. A rotor is within the housing and has at least two apices. If, in the Wankel form, it will have three such apices.

There is provided a plurality of apex seals, one at each of the apices, for establishing a seal between the rotor and the interior wall of the housing. According to the invention, each such seal is thin walled and hollow and further includes a fluid inlet and a fluid outlet. Conduits in the rotor are provided for directing a coolant through each of the seals via the inlets and the outlets. As a result, seal temperature can be closely controlled to a relatively low temperature, well below high temperatures causing accelerated wear.

According to a highly preferred embodiment of the invention, each of the seals includes a corrugated undersurface for flexibility to allow the same to conform to the shape of the interior wall. A highly preferred embodiment contemplates the provision in the rotor of seal receiving grooves at each of the apices with the coolant conduits including upwardly opening ports in each of the grooves. Each inlet and each outlet of the corresponding seal includes a tubular member extending downwardly into the corresponding groove and received in one of the ports. This feature allows for easy assembly since the seals are held in place during assembly.

It is also contemplated that sealing means surround each of the tubes within the corresponding ones of the ports.

The invention also contemplates that the tubes defining each inlet and outlet be Z-shaped.

Other objects and advantages will become apparent from the following specification taken in connection with the accompanying drawings.

DESCRIPTION OF THE PREFERRED EMBODIMENT

Figure 1:
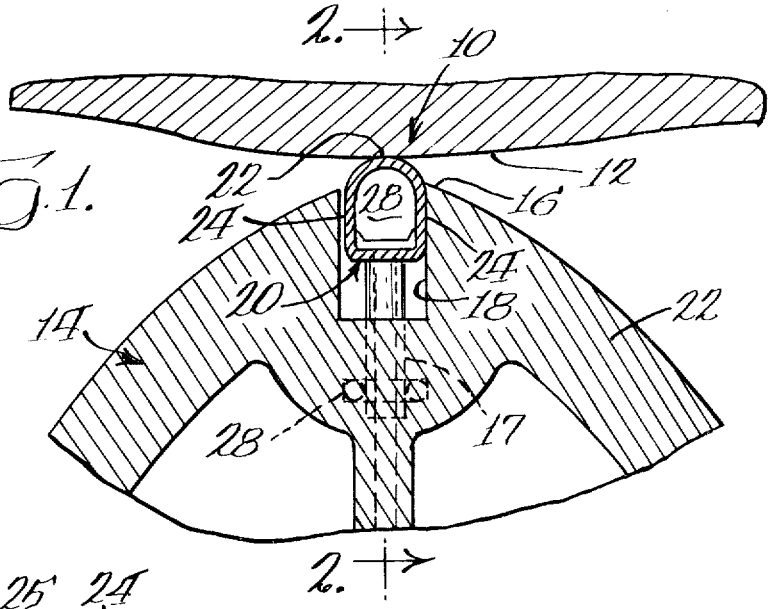
FIG. 1 is a somewhat schematic sectional view of a rotary engine embodying the invention.

An exemplary embodiment of a rotary engine embodying the invention is illustrated in the drawings and is configured in the form of a so-called "Wankel" engine. The engine includes a housing, generally designated 10, having an interior wall 12. Within the housing, a rotor, generally designated 14, is suitably journalled in a manner well known. The rotor 14 includes three apices 16 (only one of which is shown). At each apex 16 there is provided a seal receiving groove 18 for receipt of an apex seal, generally designated 20.

Each apex seal 20 has a radially outermost surface 22 which is adapted to sealingly engage the interior wall 12 of the housing 10. In addition, each seal has opposed side walls 24 which sealingly engage one or the other of the sides of the groove 18. In this connection, the side wall 24 and the groove 18 may generally be configured in any suitable fashion, preferably to provide for so-called "gas loading" to achieve the aforementioned seal against the side wall of the groove 18.

Figure 2:
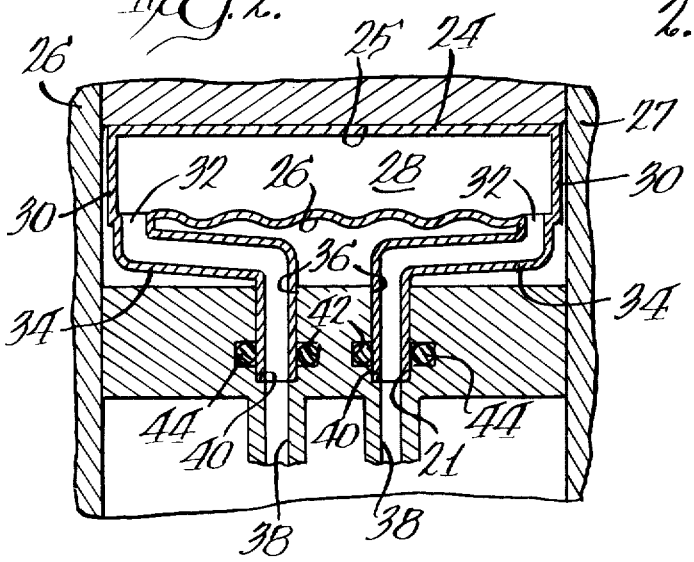
FIG. 2 is a section taken approximately along the line 2—2 of FIG. 1.
Figure 3:
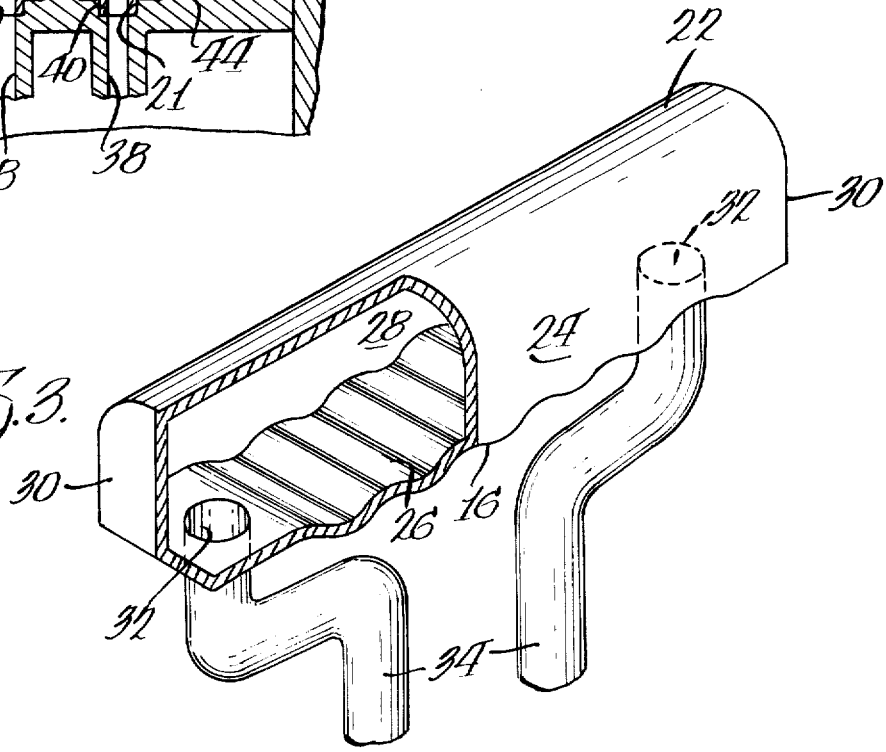
FIG. 3 is a perspective view of the seal per se.

As best seen in FIG. 2, the underside of each seal is provided with a corrugated or undulated surface 26 for flexibility to allow the same to conform to the shape of the interior wall 12. In addition, each seal is formed as a hollow thin walled member having an interior cavity 28 extending the length of the seal and closed by end walls 30. Depending upon the material of which the walls are formed, they may have a thickness as little as 0.020 inches. The material used will, of course depend upon the engine design in terms of rpm, intended operating temperatures, etc.

Adjacent each end wall 30 there is an opening 32 in the undersurface 26. Each opening 32 establishes fluid communication with a Z-shaped tube 34. One of the tubes 34 is adapted to serve as an inlet while the other is adapted to serve as an outlet. The tubes 34 are flexible.

The undersurface of the groove 18 is provided with upwardly opening ports 36, each for receiving one end of a corresponding one of the tubes 34. The ports 36 are in fluid communication with bores 38 which extend radially inwardly in the rotor 14 to terminate in ports (not shown) fronting on associated ports (not shown) in the eccentric of the rotor shaft (not shown). Provision of such ports is well within the skill of the ordinary artisan and forms no part of the instant invention.

Each of the conduits 38 is provided with an enlarged shoulder 40 against which the lowermost end of each of the tubes 34 may abut for positioning purposes. In addition, an annular groove 42 is provided for receipt of an O-ring seal 44 which sealingly engages the exterior surface of each of the tubes 34.

The porting is arranged so that a coolant may be directed into one of the tubes 34 to flow through the interior cavity 28 of each seal and out the other tube 34. Cooling oil, appropriately regulated in temperature, is employed. Preferably, cooling oil temperature is maintained below that of water coolant employed to cool the housing 10 through cooling passages (not shown). When such is the case, because oil is a less efficient coolant, the temperature of the housing and the temperature of the seal will tend to track each other, allowing the setting of a low initial end clearance at each seal which can then be maintained under all conditions of operation. Consequently, seal leakage may be minimized.

It will also be recognized that through the invention the operating temperature of each seal can be maintained at a relatively low level, well below the higher temperatures conducive to accelerated wear. In this respect, those skilled in the art will appreciate that at higher temperatures, the oil film between the seal and the interior wall 12 will be relatively thin, while at lower temperatures, a thicker oil film which will minimize wear may be maintained. According to the invention, the heat applied to the seals through frictional contact with the interior wall 12 and through contact with combustion gases is dissipated relatively easily through the thin walls of the seals to the internal coolant.

In contrast, in the ordinary construction, such heat is dissipated by conduction first through the seal itself, the thermal conductivity of which is generally quite low, then through the junction between the seal and the rotor, and finally through the rotor walls in the vicinity of its apices through the cooling medium. With the instant invention, this tortuous path of heat transfer is minimized and, in particular, the junction barrier at the interface between the seal and the groove is totally eliminated thereby greatly enhancing heat transfer and the ability to maintain the seals sufficiently cool so as to allow the development of a thick oil film between the seal and the interior wall of the housing 10.

While the invention has been described in connection with apex seals employed in trochoidal type engines, those skilled in the art will recognize that the same is applicable to side seals in such engines as well. Moreover, the invention is applicable to compression seals in other rotary engines such as tip seals or peripheral seals employed in a slant axis rotary engine.

Finally, the invention may also be advantageously employed in connection with compression seals, as piston rings in reciprocating engines and no limitation to any particular type of engine is intended unless specifically stated in the following claims.

I claim:

1. A rotary engine comprising:

a housing having an interior wall;

a rotor within said housing;

a plurality of seals carried by said rotor and engaging said interior wall for establishing a seal between said rotor and said interior wall; each said seal being thin walled and hollow and further having a fluid inlet and a fluid outlet; and means, including conduits in said rotor for directing a coolant through each of said seals via the inlets and outlets of each said seal and said conduits, each said seal including a corrugated surface for flexibility to allow the same to conform to the shape of said interior wall.

2. A rotor engine comprising:

a housing having an interior wall;

a rotor within said housing;

a plurality of seals carried by said rotor and engaging said interior wall for establishing a seal between said rotor and said interior wall; each said seal being thin walled and hollow and further having a fluid inlet and a fluid outlet; and means, including conduits in said rotor for directing a coolant through each of said seals via the inlets and outlets of each said seal and said conduits, said rotor including a seal receiving groove for each of said seals, said conduits include ports in each said groove, and each said inlet and outlet comprises a flexible tube extending from the corresponding seal to one of the ports in the corresponding groove.

* * * * *